US009909444B2

(12) United States Patent
Rousselin et al.

(10) Patent No.: US 9,909,444 B2
(45) Date of Patent: Mar. 6, 2018

(54) MEASUREMENT INSTALLATION FOR BLADE FAILURE TESTING IN A TURBOMACHINE

(71) Applicant: SNECMA, Paris (FR)

(72) Inventors: Stephane Rousselin, Hericy (FR); Jean-Francois Adnot, Viry Chatillon (FR); Patrick Marcellin, Savigny le Temple (FR)

(73) Assignee: SNECMA, Paris (FR)

( * ) Notice: Subject to any disclaimer, the term of this patent is extended or adjusted under 35 U.S.C. 154(b) by 887 days.

(21) Appl. No.: 14/051,749

(22) Filed: Oct. 11, 2013

(65) Prior Publication Data

US 2014/0105727 A1 Apr. 17, 2014

(30) Foreign Application Priority Data

Oct. 12, 2012 (FR) ..... 12 59738

(51) Int. Cl.
*F01D 5/02* (2006.01)
*F01D 21/00* (2006.01)

(52) U.S. Cl.
CPC ..... *F01D 21/003* (2013.01); *F01D 5/02* (2013.01)

(58) Field of Classification Search
CPC ..... F01D 5/02; F01D 21/003; F05D 2240/61
USPC ..... 415/118; 416/1, 61
See application file for complete search history.

(56) References Cited

U.S. PATENT DOCUMENTS 3,208,269 A * 9/1965 Eccles ..... F16C 33/34 310/156.08
4,967,550 A * 11/1990 Acton ..... F01D 25/06 415/119
5,005,353 A * 4/1991 Acton ..... F01D 17/02 415/119
5,082,421 A * 1/1992 Acton ..... F01D 17/02 415/118
5,141,391 A * 8/1992 Acton ..... F01D 17/02 381/71.7
5,462,410 A * 10/1995 Smith ..... B64C 11/30 277/637
6,584,849 B2 * 7/2003 Loftus ..... G01H 1/006 73/659

(Continued)

FOREIGN PATENT DOCUMENTS

FR 2 816 061 5/2002
GB 2319812 A * 6/1998 ..... F01D 5/027

(Continued)

OTHER PUBLICATIONS

French Preliminary Search Report dated Jul. 8, 2013, in French 1259738, filed Oct. 12, 2012 (with English Translation of Categories of Cited Documents).

*Primary Examiner* — Sean J Younger

(74) *Attorney, Agent, or Firm* — Oblon, McClelland, Maier & Neustadt, L.L.P.

(57) ABSTRACT

A turbomachine fitted with a device for gathering the information recorded during operation of the former by a strain gauge positioned on a fan blade borne by a fan disc of the turbomachine, the device including a hollow cylindrical pipe positioned inside one of the rotating shafts of the turbomachine in order to guide at least one wire for transmitting this information, wherein the device further includes a part for attaching the pipe to the rotating shaft.

13 Claims, 3 Drawing Sheets

(56) References Cited

U.S. PATENT DOCUMENTS 7,135,867 B2 * 11/2006 Pang ..... G01D 3/08 324/242
7,584,924 B2 * 9/2009 Ow ..... B64C 29/0025 244/12.3
7,611,091 B2 * 11/2009 Ow ..... B64C 29/0025 244/12.2
7,849,752 B2 * 12/2010 Gregory ..... G01B 7/16 73/760
2009/0121896 A1 * 5/2009 Mitchell ..... H04Q 9/00 340/870.31
2010/0117859 A1 * 5/2010 Mitchell ..... F01D 17/02 340/870.16
2010/0219942 A1 * 9/2010 Lee ..... F01D 17/02 340/10.51
2010/0226756 A1 9/2010 Mitchell et al.
2011/0133949 A1 * 6/2011 Subramanian ..... F23R 3/00 340/870.28
2011/0133950 A1 * 6/2011 Subramanian ..... F01D 5/12 340/870.28
2011/0219862 A1 * 9/2011 Sand ..... F02K 3/04 73/116.03
2012/0096946 A1 * 4/2012 Schleif ..... F01D 17/08 73/756
2012/0096961 A1 4/2012 Schleif et al.
2012/0101775 A1 * 4/2012 Mitchell ..... F01D 21/003 702/183
2012/0197597 A1 * 8/2012 Mitchell ..... F01D 17/20 702/188

FOREIGN PATENT DOCUMENTS

WO WO 2008/091289 A2 7/2008
WO WO 2013/126116 A2 8/2013

* cited by examiner

MEASUREMENT INSTALLATION FOR BLADE FAILURE TESTING IN A TURBOMACHINE

The field of the present invention is that of turbomachines and, in particular, that of instrumentation for testing these turbomachines.

Before entering service, turbomachines must undergo numerous tests intended to ensure both that they function correctly when in use and that they are able to withstand possible mechanical failures of one of their components. It is particularly expedient to show a turbomachine's capacity to maintain its physical integrity, and to contain fragments which may become detached from the machine, in the event of a fan blade failure. To that end, retention tests are organized, before the turbomachine is certified, in which one of the fan blades is made to fail. It is essential during these tests to measure the stresses to which the various components are subjected and instrumentation is installed specifically on these, and in particular on the fan blades, during the tests.

Strain gauges, fitted with a wire, are thus placed on the fan blades in order to measure, at several locations, the stresses to which the blades are subjected during the test. The instrumentation installed is rotating instrumentation, wherein all the elements are driven in rotation together with the fan blades. The measured values must be conveyed out of the turbomachine and, to that end, the wires of the gauges are connected, via a connector, to measurement-transmitting wires which are located close to the axis of the engine and which run inside the low-pressure shaft thereof. For the testing, a pipe is therefore put in place inside the LP shaft in order to contain this wire and guide it out of the engine.

The instrumentation is generally installed as follows:

The fan blades are first of all pre-fitted with strain gauges, with their gauge wires left loose, and measurement-transmitting wires are placed in a pipe inside the LP shaft. The fan blades are mounted on the disc and the wires from the gauges are connected, using suitable connectors, to the measurement-transmitting wires. Moreover, the various wires are clipped onto the parts in order to avoid them moving under the effect of the forces which act when the engine being tested is in rotation.

In order to make this installation possible, the various wires are produced with excess lengths of wire which must be positioned, after installation, in a particular location where they are not at risk of becoming tangled, which could cause them to break during use. In the prior art, the excess length of these wires was located below the fan, between the bulb-shaped parts of the fan discs, there being generally two of these. The first drawback of this configuration is that it is almost impossible to attach the wires, by means of cable clips, to the fan shaft downstream of the second bulb, between this second bulb and the upstream end of the LP shaft, as access to this portion via the front of the engine is very difficult. One solution had been found, by installing a substantially radial part which was placed between the pipe for guiding the measurement wires and the first bulb of the disc, the latter being attached by fitting over the end of the bulb. However, this configuration had the second drawback of not being suited to modern engines which have no bulbs at the level of the fan shaft, the disc being of the disc-ring type which is continuous in the longitudinal direction.

The objective of the present invention is to solve these drawbacks by proposing a device for supporting a wire coming from a moving blade, allowing it to be secured regardless of the shape of the disc which bears said blade.

To that end, the invention relates to a turbomachine fitted with a device for gathering the information recorded during operation of the former by a strain gauge positioned on a fan blade borne by a fan disc of said turbomachine, said device comprising a hollow cylindrical pipe positioned inside one of the rotating shafts of said turbomachine in order to guide at least one wire for transmitting this information, characterized in that said device further comprises a part for attaching said pipe to said rotating shaft.

Fixing the attachment part to a rotating shaft of the turbomachine, preferably to a disc root as in the prior art, allows the device to be more compact and suitable for installation in modern engines. This device for gathering measurements is particularly suited to a fan blade loss test on a high-bypass ratio jet engine.

The attachment part preferably bears a part for guiding the wire towards its ingress into said pipe, said guiding part comprising a region, for gathering the excess lengths of said wire, formed by a wall extending in the axial direction and at least one wall extending in the radial direction. This region makes it possible to position therein the excess lengths of wire which are an intrinsic part of the design for measurement cabling and are necessary in order to allow them to be installed on the engine, without these excess lengths of wire hampering the operation of the turbomachine or being in danger of breaking under the effect of the forces generated by the rotation of the turbomachine.

In one preferred embodiment, the disc bearing the fan blades is a disc-ring. It even becomes essential to choose such a device when the fan disc does not comprise a bulb-shaped root.

In one particular embodiment, the rotating shaft is a low-pressure shaft, said shaft extending axially in the upstream direction until it is below said disc-ring.

Advantageously, said attachment part attaches to said rotating shaft by axially gripping splines which extend radially inside said shaft.

In one preferred embodiment, the guiding part extends axially in the upstream direction until it is in line with one of the axial ends of the fan disc. The wire for gathering the measurements then passes radially between the fan disc and the guiding part, which is beneficial for the integrity of the wire as the turbomachine rotates.

In one particular embodiment, the guiding part comprises an axial cylindrical portion from which a disc-shaped radial portion extends in the direction of said axial end of the fan disc. This disc-shaped portion can come as close as possible, and radially, to the fan disc which makes it easier for the wire to pass from the disc to the guiding part.

Preferentially, said radial portion extends towards the inside of said cylindrical portion via a radial extension which forms a wall of said region for gathering the excess lengths of wire.

In one particular embodiment, the radial portion of the guiding part comprises holes which allow the wire to pass from one of the faces of said disc to the opposite face.

The invention will be better understood, and other objectives, details, features and advantages thereof will become more clearly apparent from the following purely illustrative and non-limiting detailed explanatory description of an embodiment of the invention, with reference to the appended schematic drawings, in which.

Figure 1:
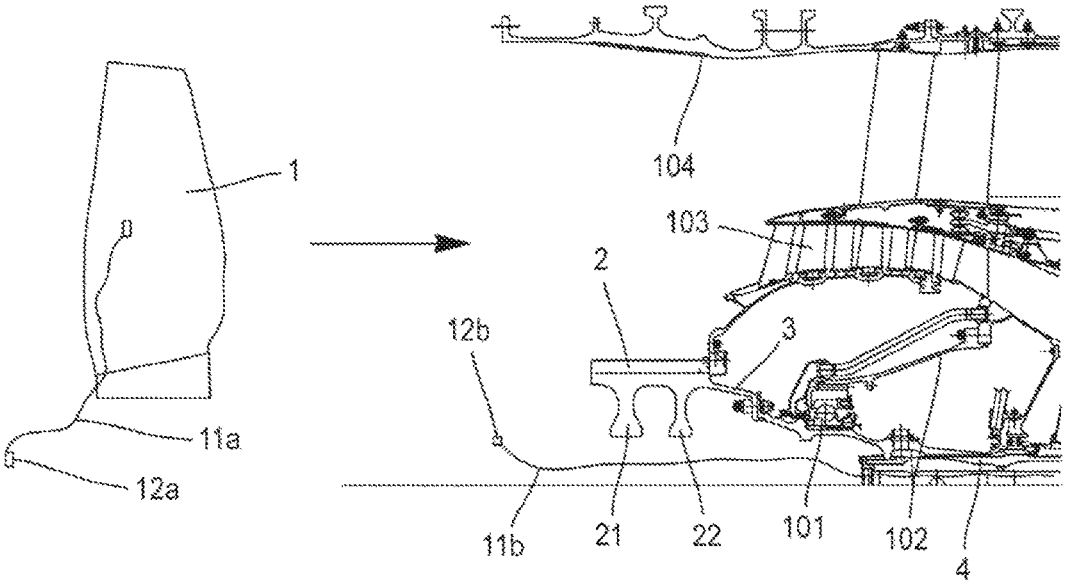
Fig. 1 Prior Art
FIG. 1 is a view in section of the front portion of a turbomachine fitted with a measurement installation according to the prior art.

FIG. 1 shows the front portion of a turbomachine of the prior art, comprising fan blades 1 which are not installed and are designed to be mounted on a fan disc 2 which in turn is attached, via its fan shaft 3, to the low-pressure compressor shaft or LP shaft 4. In a conventional configuration, the LP shaft is borne by a forward rolling bearing 101 which is itself borne by the structure of the intermediate casing 102 of the turbomachine. FIG. 1 also shows the low-pressure compressor 103 and the outer fan casing 104.

A strain gauge 10 is attached to the fan blade 1, a first section of wire 11*a* extending from the strain gauge in order to transmit the recorded strain information, wherein this wire ends at a first connector 12*a*. This first wire is connected, via a second connector 12*b*, to a second section of wire 11*b* so as to form the wire 11 for transmitting the data out of the turbomachine and to a system for recording the measurements during the projected test. The second section 11*b* extends towards the LP shaft 3, which it passes through to reach the device (not shown) for transferring the information from the rotating portion of the measurement installation to the stationary portion thereof In the situation shown, which corresponds to a turbomachine of the prior art, the fan disc comprises two bulb-shaped radial extensions 21 and 22, between which there is a space serving as a wire storage space, inside which the excess lengths of measurement wire 11 could be coiled up after the fan blades 1 have been mounted on the fan shaft 3.

Figure 2:
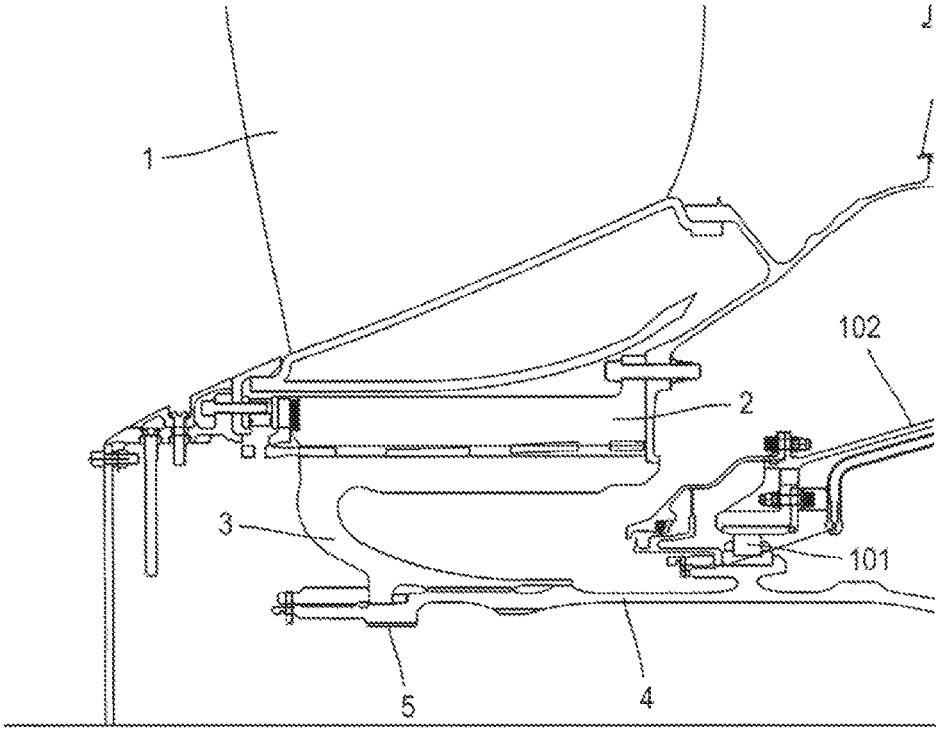
FIG. 2 is a view in section of the front portion of a turbomachine designed to receive a measuring device according to one embodiment of the invention.

FIG. 2 shows the front portion of a modern engine, having no bulbs below the fan disc, these having been replaced by a ring-shaped cylindrical disc which extends beneath the root of the fan blades 1. The fan shaft 3 has a U-shaped (or more specifically a hairpin-shaped) cross section, so as to connect with the LP disc 4, which thus extends in the longitudinal direction to below the disc-ring 2. It should be noted that, as is conventional, the LP shaft comprises, on its internal face and at the level of its upstream end, notches 5 in the form of splines which prevent the LP shaft from rotating when the nut for attaching the fan disc 3 is tightened.

Figure 3:
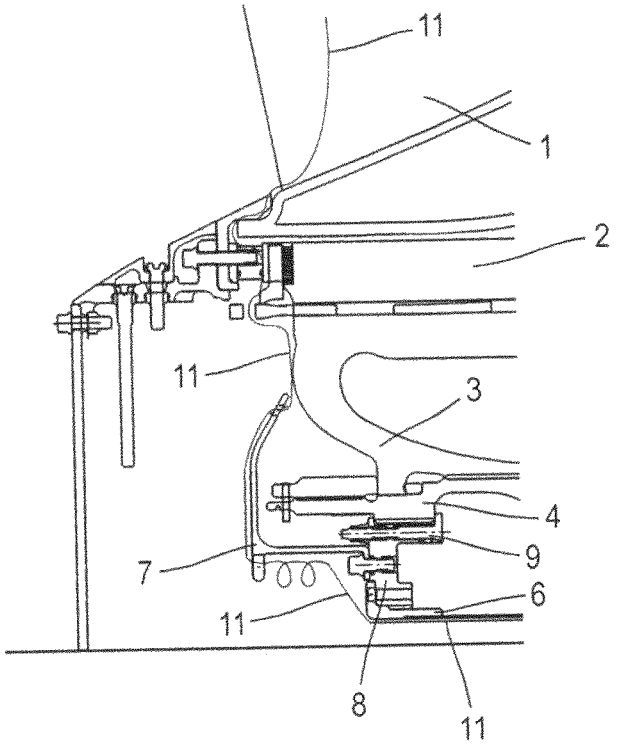
FIG. 3 is a view in section of the front portion of FIG. 2 fitted with a measuring device according to one embodiment of the invention.
Figure 4:
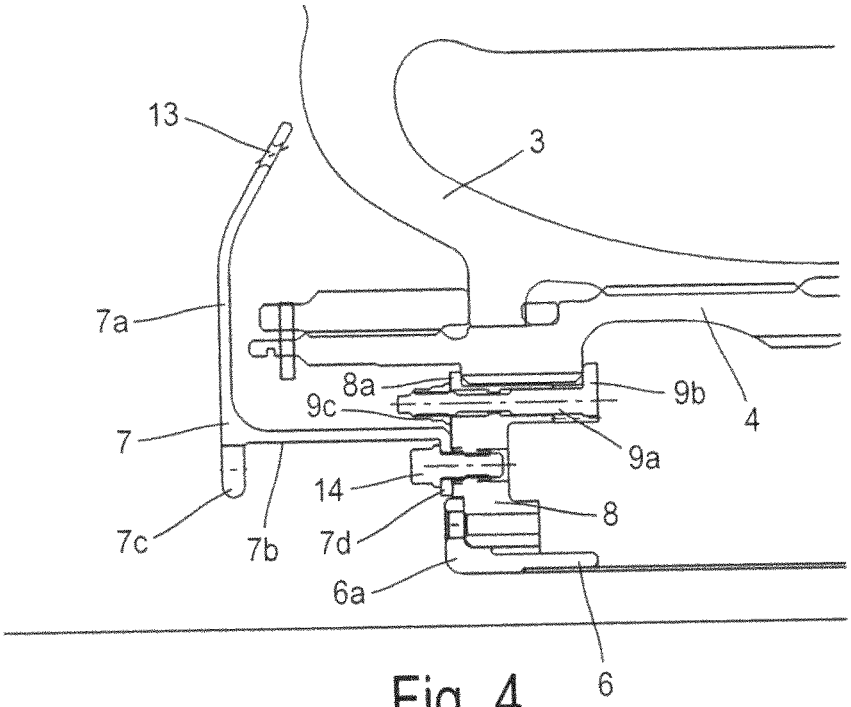
FIG. 4 is a detail view of the device from FIG. 3.

FIGS. 3 and 4 show the same front portion of the engine, having a pipe 6 for guiding the data transmission wire 11, installed for carrying out a blade failure test. The wire runs from the fan blade 1 to this pipe 6, first passing through the fan disc 2 in the region of the blade root slots, then along the upstream face of the fan shaft 3 and finally along a flange 7 for holding and guiding the wire towards the pipe 6. As can be seen in FIG. 4, this flange has, on the upstream side, a radial portion 7*a* in the shape of a recurved disc, which is positioned longitudinally substantially level with the upstream face of the fan shaft 3, so as to offer an extension for the wire in the radial continuity of this upstream face. It continues in the downstream direction via a cylindrical portion 7*b* which is coaxial with the engine and which ends at a radial attachment flange 7*d* so as to attach to a part 8 for supporting the pipe 6, which will be described in more detail below. The radial portion 7*a*, at that end which is close to the fan shaft 3, features a hole 13 which allows the wire 11 to pass through this flange from the concave side thereof, oriented towards the fan shaft 3, to the convex side and thus pass around the flange so as to reach the interior flank of its cylindrical portion 7*b*. Moreover, the radial portion 7*a* projects downwards via an extension 7*c* which extends below its axial portion 7*a* so as to form a barrier preventing the measurement wire 11 from returning in the upstream direction. The axial portion 7*b* thus forms, together with this radial extension 7*c*, a wire storage cavity, inside which the excess lengths of the wires 11 from the blades 1 being investigated can be positioned, as was the case in the prior art with the cavity between the bulbs.

At its upstream end, the pipe 6 for guiding the wire 11 has a crimped collar 6*a* which serves as an attachment flange for the pipe. This collar comprises, as is conventional, a series of holes arranged regularly around the periphery of the collar and designed to receive attachment means of the screw or nut-and-bolt type for fastening the pipe 6 on the support part 8 and, finally, through it, on the LP shaft 4, by means of which it is driven in rotation. In the remainder of the description the generic term "pipe" relates to the assembly formed of the pipe itself and its collar. The support part 8 is substantially in the shape of a hollow cylinder extending from the LP shaft 4, with which it is in contact by means of its notches 5, to the collar 6*a* of the pipe 6. It comprises at its upper portion an upstream lock 8*a*, in the form of a radial rib which extends in the axis of its upstream face and which comes to press against the radial upstream portion of the notch 5. Moreover, it features a first series of holes on its circumference, these holes accepting attachment means 9 of the nut-and-bolt type, wherein the bolt 9*a* bears, on the downstream side, a radial extension 9*b* which presses against the downstream radial portion of the notch 5. Tightening the nut 9*c* of the attachment means 9 against the upstream face of the support part 8 traps the notch 5 and locks the support part 8 in position on the LP shaft 4. By virtue of the anti-rotation function of the notches 5, this tightening secures the support part 8 and, therefore, the pipe 6 in rotation with the LP shaft 4 of the engine. The support part also has a second series of holes on its circumference, wherein these holes are tapped and receive the screws 14 for attaching the flange 7, which screws pass through the latter at the level of its radial attachment flange 7*d*. Finally, a third series of holes receives the screws for attaching the collar 6*a* of the pipe 6.

Figure 5:
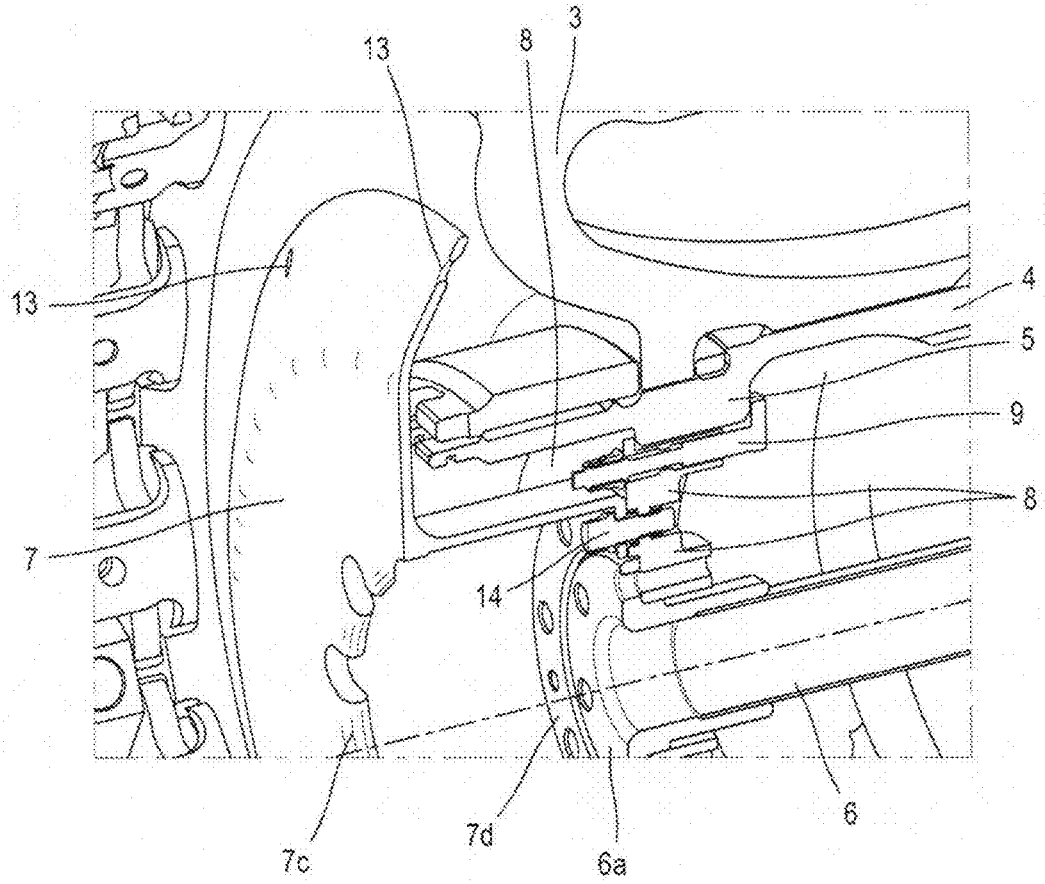
FIG. 5 is a view in section and in perspective of the device from FIG. 3.

Finally, FIG. 5 shows in perspective, in the same way as FIG. 4, the arrangement of the various elements shown above. It should be noted, inter alia, that the flange 7 features, on its radial extension 7*c*, as many holes as necessary so as to be able to pass through it a tightening tool able to reach the screws or bolts for attaching the various elements fastened to the support part 8.

Mounting the measuring device thus involves installing the support part 8 at the level of the notches 5 of the LP shaft 4 and pressing its upstream rib 8*a* against the upstream face of said notch, then attaching this part using the attachment means 9. The bolt 9*a* is then pressed against the downstream face of the notch 5 and tightening the nut 9*d* causes the notch 5 to be trapped between the radial extension 9*b* of the bolt and the rib 8*a* of the support part. The support part being thus secured to the LP shaft 4, the pipe 6 is mounted thereon using screws or nut-and-bolt fasteners which pass through its collar 6*a*. Moreover, the flange 7 is also mounted on the support part 8, pressing its radial attachment flange 7*d* against the latter and attaching it using the nut-and-bolt fasteners 14.

It should be noted that these instrumentation means are mounted on the already-assembled turbomachine and that none of the components of the latter need be disassembled, provided that the strain gauges are already installed on the fan blades 1. All that remains to do is to connect the sections of wires from the gauges 11*a* to the sections of the measurement wires 11*b* at the connectors 12*a* and 12*b* and then to attach the wire 11 obtained, by means of cable clips, along its entire path over the various parts of the turbomachine, passing by the roots of the blades and passing through the flange 7 from the downstream side to the upstream side via the holes 13. The wire is placed such that it follows the shortest possible path and such that the excess lengths are gathered at the wire storage cavity formed by the radial extension 7*c* and the axial cylindrical portion 7*b* of the flange 7.

The various advantages provided by this configuration of the measurement installation device are, in addition to the fact that it is suitable for a turbomachine whose fan disc 2 is a disc-ring, that:

it is a relatively compact system which does not alter the behaviour of the fan disc when a blade is lost, the engine is easier to mount on the test bench since the device can be installed once the turbomachine is assembled and already installed on the test bench, and it is possible to install the system even in a small turbomachine and when there is very little available space.

The invention claimed is:

1. A turbomachine comprising:

a device for gathering information recorded during operation of the turbomachine by a strain gauge positioned on a fan blade borne by a fan disc of said turbomachine, said device comprising a hollow cylindrical pipe positioned inside a rotating shaft of said turbomachine in order to guide at least one wire for transmitting said information, an attachment part for attaching said pipe to said rotating shaft, and a guiding part for guiding said at least one wire between said strain gauge and said pipe, said guiding part comprising a radial portion extending radially outside said rotating shaft and an axial cylindrical portion which is disposed radially inside said rotating shaft and which extends upstream of the attachment part, wherein the attachment part bears against an attachment flange provided at a first end of said axial cylindrical portion of said guiding part, and wherein said radial portion forms a disc-shaped radial portion which extends from a second end of said axial cylindrical portion in a direction of an axial end of the fan disc.

2. The turbomachine according to claim 1, wherein said guiding part comprising a region, for gathering excess lengths of said at least one wire, formed by the axial cylindrical portion and at least one wall extending in the radial direction.

3. The turbomachine according to claim 2, wherein the region is arranged axially upstream of the attachment part.

4. The turbomachine according to claim 1, wherein the fan disc bearing the fan blades is a disc-ring.

5. The turbomachine according to claim 4, wherein the rotating shaft is a low-pressure shaft, said rotating shaft extending axially in the upstream direction until said rotating shaft is below said disc-ring.

6. The turbomachine according to claim 1, wherein said attachment part attaches to said rotating shaft by axially gripping splines which extend radially inside said rotating shaft.

7. The turbomachine according to Claim 1, wherein said disc-shaped radial portion extends towards an inside of said axial cylindrical portion via a radial extension which forms a wall of said region for gathering excess lengths of wire.

8. The turbomachine according to Claim 1, wherein the disc-shaped radial portion of the guiding part comprises holes which allow the at least one wire to pass from one face of said fan disc to an opposite face of said fan disc.

9. The turbomachine according to claim 1, wherein said axial cylindrical portion extends axially outside said rotating shaft.

10. A turbomachine comprising:

a device for gathering information recorded during operation of the turbomachine by a strain gauge positioned on a fan blade borne by a fan disc of said turbomachine, said device comprising a hollow cylindrical pipe positioned inside a rotating shaft of said turbomachine in order to guide at least one wire for transmitting said information, an attachment part for attaching said pipe to said rotating shaft, and a guiding part for guiding said at least one wire between said strain gauge and said pipe, said guiding part comprising a radial portion extending radially outside said rotating shaft, wherein said guiding part comprises an axial portion extending axially outside said rotating shaft, and wherein said axial portion is positioned between said radial portion and said rotating shaft such that said at least one wire is guided by said guiding part successively from said fan blade, through said radial portion, through said axial portion and finally to said pipe inside said rotating shaft.

11. The turbomachine according to claim 1, wherein said at least one wire transmits data from said strain gauge to a system for recording measurements made with said strain gauge on the fan blade, wherein said system is outside the turbomachine.

12. A turbomachine comprising:

a device for gathering information recorded during operation of the turbomachine by a strain gauge positioned on a fan blade borne by a fan disc of said turbomachine, said device comprising a hollow cylindrical pipe positioned inside a rotating shaft of said turbomachine in order to guide at least one wire for transmitting said information, an attachment part for attaching said pipe to said rotating shaft, and a guiding part for guiding said at least one wire between said strain gauge and said pipe, said guiding part comprising a radial portion and an axial portion disposed radially inside of said rotating shaft, wherein said rotating shaft includes a spline provided on an internal face of said rotating shaft at an upstream end of said rotating shaft, and wherein said attachment part comprises a support part having a cylindrical shape and including a radial rib, said support part being fastened radially between said pipe and said rotating shaft such that the radial rib abuts an upstream portion of the spline, and a radial extension of a bolt passing through said support part abuts a downstream portion of the spline so that said pipe is secured in rotation with said rotating shaft.

13. The turbomachine according to claim 12, wherein said guiding part comprises a region, for gathering excess lengths of said at least one wire, formed by a wall extending in the axial direction and at least one wall extending in the radial direction.

* * * * *